US011781287B2

(12) United States Patent
Konishi et al.

(10) Patent No.: US 11,781,287 B2
(45) Date of Patent: Oct. 10, 2023

(54) HYDRAULIC CIRCUIT FOR A CONSTRUCTION MACHINE

(71) Applicant: Caterpillar SARL, Geneva (CH)

(72) Inventors: Isao Konishi, Akashi (JP); Genta Mine, Akashi (JP); Yuya Kanenawa, Akashi (JP); Shinya Ohmura, Akashi (JP); Sei Shimahara, Akashi (JP); Kazuya Miyamori, Akashi (JP)

(73) Assignee: Caterpillar SARL, Geneva (CH)

( * ) Notice: Subject to any disclaimer, the term of this patent is extended or adjusted under 35 U.S.C. 154(b) by 0 days.

(21) Appl. No.: 17/973,789

(22) Filed: Oct. 26, 2022

(65) Prior Publication Data

US 2023/0131384 A1 Apr. 27, 2023

(30) Foreign Application Priority Data

Oct. 26, 2021 (JP) ..... 2021-174755

(51) Int. Cl.

| | |
|---|---|
| ***E02F 9/22*** | (2006.01) |
| ***E02F 9/20*** | (2006.01) |
| ***F15B 15/00*** | (2006.01) |
| ***F15B 13/02*** | (2006.01) |

(52) U.S. Cl.

CPC ..... *E02F 9/2235* (2013.01); *E02F 9/2004* (2013.01); *E02F 9/2228* (2013.01); *E02F 9/2275* (2013.01); *E02F 9/2296* (2013.01); *F15B 13/024* (2013.01); *F15B 15/00* (2013.01); *E02F 9/2285* (2013.01); *E02F 9/2292* (2013.01)

(58) Field of Classification Search

CPC .... F15B 2211/50518; F15B 2211/6654; F15B 13/024; E02F 9/2235

See application file for complete search history.

(56) References Cited

U.S. PATENT DOCUMENTS 5,197,864 A * 3/1993 Lunzman ..... F04B 49/08 417/218
2005/0129531 A1* 6/2005 Fenny ..... F15B 20/007 417/279

(Continued)

FOREIGN PATENT DOCUMENTS

JP 2008082107 A 4/2008
JP 2010168738 A 8/2010

(Continued)

*Primary Examiner* — Abiy Teka

(57) ABSTRACT

Problem to be solved: To provide a hydraulic circuit for the construction machine which enables to use the relief valve of low capacity in the work tool circuit. Solution: The hydraulic circuit 2 for a construction machine has: a hydraulic pump 4 of variable capacity, a work tool 6 operated by hydraulic oil delivered by the hydraulic pump 4, a work tool operating device 10 to output a signal for operating the work tool 6, a control valve 14 allowing the hydraulic pump 4 to supply the hydraulic oil to the work tool 6 based on the signal output from the work tool operating device 10, a tool's relief valve 44 to release the hydraulic oil flowing between the control valve 14 and the work tool 6, a pressure sensor 46 to detect a pressure of hydraulic oil flowing into the work tool 6, and a controller 48 to reduce a delivery rate from the hydraulic pump 4 when the pressure detected by the pressure sensor 46 exceeds a predetermined value.

11 Claims, 4 Drawing Sheets

(56) References Cited

U.S. PATENT DOCUMENTS

| | | | | |
|---|---|---|---|---|
| 2011/0020146 | A1* | 1/2011 | Akiyama | E02F 9/2296 417/213 |
| 2014/0060020 | A1* | 3/2014 | Peterson | E02F 9/2296 60/420 |
| 2014/0322045 | A1* | 10/2014 | Sakamoto | F04B 1/29 417/364 |

FOREIGN PATENT DOCUMENTS

| | | | |
|---|---|---|---|
| JP | 2016145592 | A | 8/2016 |
| JP | 2019173468 | A | 10/2019 |
| WO | 2016076288 | A1 | 5/2016 |

* cited by examiner

HYDRAULIC CIRCUIT FOR A CONSTRUCTION MACHINE

CROSS-REFERENCE TO RELATED APPLICATION

This application claims priority under 35 USC § 119 and the Paris Convention to Japanese Patent Application 2021-174755 filed on Oct. 26, 2021.

FIELD OF THE INVENTION

The present invention relates to hydraulic circuit for a construction machine where various work tools are detachably installed.

BACKGROUND OF THE INVENTION

A hydraulic excavator as a typical example of construction machines has a lower traveling body, an upper swiveling body swivelably supported on the lower traveling body, and a front working machine installed on the upper swiveling body. A front working machine for hydraulic excavator includes a boom coupled swingably to an upper swiveling body, an arm coupled swingably to a distal end of the boom, and a work tool installed detachably on the distal end of the arm.

Many hydraulic excavators are installed with a bucket for excavation work as the work tool, and various work tools may be installed besides the bucket. A hydraulic hammer for crushing concrete, rocks, and so on, and a grapple for grabbing wood and so on are examples of work tools besides the bucket (see PTL 1, for example).

PRIOR ART DOCUMENT

Patent Document

PTL 1: Japanese Unexamined Patent Application Publication No. 2010-168738

SUMMARY OF THE INVENTION

Problems to be Solved by Invention

Such a work tool includes those which release the hydraulic oil through a relief valve from the circuit (work tool circuit) to operate the work tool (grapple, for example). When using such a work tool, a relief valve of large capacity is needed to be installed in a work tool circuit to deliver a full flow from a pump during the relief. However, the relief valve of large capacity is expensive, causing a cost increase in the work tool circuit.

Also, some work tools are required to set a relief pressure lower than the relief pressure of the entire circuit for the hydraulic excavator. When using this work tool and any other actuator than the work tool simultaneously, the pressure of the entire circuit rises only up to the relief pressure of the work tool, causing a problem that an operability of any other actuator is degraded.

In consideration of what mentioned above, a first challenge of the present invention is to provide a hydraulic circuit for the construction machine which enables to use the relief valve of low capacity in the work tool circuit. Also, a second challenge of the present invention is to provide the hydraulic circuit with excellent operability when operating the work tool and any other actuator simultaneously.

Means for Solving the Problem

According to a first aspect of this invention, a hydraulic circuit is provided to the construction machine which solves the first challenge mentioned above, as follows. That is, "A hydraulic circuit for a construction machine comprising:

a hydraulic pump of variable capacity, a work tool operated by hydraulic oil delivered by the hydraulic pump, a work tool operating device to output a signal for operating the work tool, a control valve allowing the hydraulic pump to supply hydraulic oil to the work tool based on the signal output from the work tool operating device, a tool's relief valve to release hydraulic oil flowing between the control valve and the work tool, a pressure sensor to detect a pressure of hydraulic oil flowing into the work tool, and a controller which reduces a delivery rate from the hydraulic pump when the pressure detected by the pressure sensor exceeds a predetermined value."

Preferably, the predetermined value is set to not more than the relief pressure of the tool's relief valve. The control valve appropriately has a meter-in valve which controls hydraulic oil flow rate flowing into the work tool and a meter-out valve which controls hydraulic oil flow rate flowing out of the work tool.

According to a second aspect of this invention, the hydraulic circuit for the construction machine is provided which solves the second challenge mentioned above, as follows. That is, "A hydraulic circuit for a construction machine comprising:

a hydraulic pump, a work tool and an actuator respectively operated by hydraulic oil delivered by the hydraulic pump, a work tool operating device to output a signal for operating the work tool, an actuator operating device to output the signal for operating the actuator, a control valve allowing the hydraulic pump to supply hydraulic oil to the work tool and the actuator based on the signal output from the work tool and actuator operating devices, a main relief valve disposed at an upstream side of the control valve to release hydraulic oil delivered by the hydraulic pump, a tool's relief valve to release hydraulic oil flowing between the control valve and the work tool, and a controller to control an operation of the control valve, wherein, the control valve includes meter-in/meter-out valves which control hydraulic oil flow rate flowing into/out of the work tool, wherein, when the signal is output from both the work tool and actuator operating devices, the controller reduces an opening area of the meter-in valve so that the pressure at a downstream side of the meter-in valve is made lower than that at the upstream side of the meter-in valve."

Desirably, when the signal is output from both the work tool and actuator operating devices, the controller reduces the opening area of the meter-in valve to make the pressure at the downstream side of the meter-in valve lower than that at the upstream side of the meter-in valve lest the pressure at the downstream side of the meter-in valve should reach to the relief pressure of the tool's relief valve before the pressure at the upstream side of the meter-in valve reaches to the relief pressure of the main relief valve.

The hydraulic pump is a variable capacity type and includes the pressure sensor to detect the pressure of hydraulic oil flowing into the work tool, and the controller advantageously reduces the delivery rate from the hydraulic pump when the pressure detected by the pressure sensor exceeds the predetermined value.

Both first and second aspects of this invention include first and second conduits respectively connecting the control valve and the work tool, first and second relief conduits respectively branched from the first and second conduits to a hydraulic tank, and the tool's relief valve is preferably provided in each of the first and second relief conduits. Alternatively, these aspects include first and second conduits respectively connecting the control valve and the work tool, a connecting conduit connecting the first and second conduits, a shuttle valve disposed in the connecting conduit, and the relief conduit extending from an exit of the shuttle valve to the hydraulic tank, and the tool's relief valve may be provided in the relief conduit.

The tool's relief valve is appropriately electromagnetic proportional relief valve.

Favorable Effects of the Invention

According to the first aspect of this invention, the delivery rate is reduced from the hydraulic pump when the pressure of hydraulic oil flowing into the work tool exceeds the predetermined value, so that the hydraulic oil flow rate may be suppressed passing through the tool's relief valve and the capacity of the tool's relief valve may be reduced.

According to the second aspect of this invention, when the signal is output from both the work tool and actuator operating devices, the controller reduces an opening area of the meter-in valve to make the pressure at the downstream side of the meter-in valve lower than that at the upstream side of the meter-in valve, so the pressure of hydraulic oil flowing into the actuator can be raised higher than the relief pressure of the tool's relief valve even if the relief pressure of the tool's relief valve is set lower than that of the main relief valve, and the operability becomes better when operating the work tool and actuator simultaneously.

Also, as the second aspect of this invention has the meter-in/meter-out valves which control hydraulic oil flow rate flowing into/out of the work tool, there is no need to reduce the opening of the meter-out valve in conjunction with reducing the opening of the meter-in valve, enabling to suppress back pressure increase in the work tool circuit.

DETAILED DESCRIPTION OF THE INVENTION

Now, an embodiment of the hydraulic circuit for the construction machine configured according to the present invention will be described with reference to the drawings above.

[Hydraulic Circuit 2]

Figure 1:
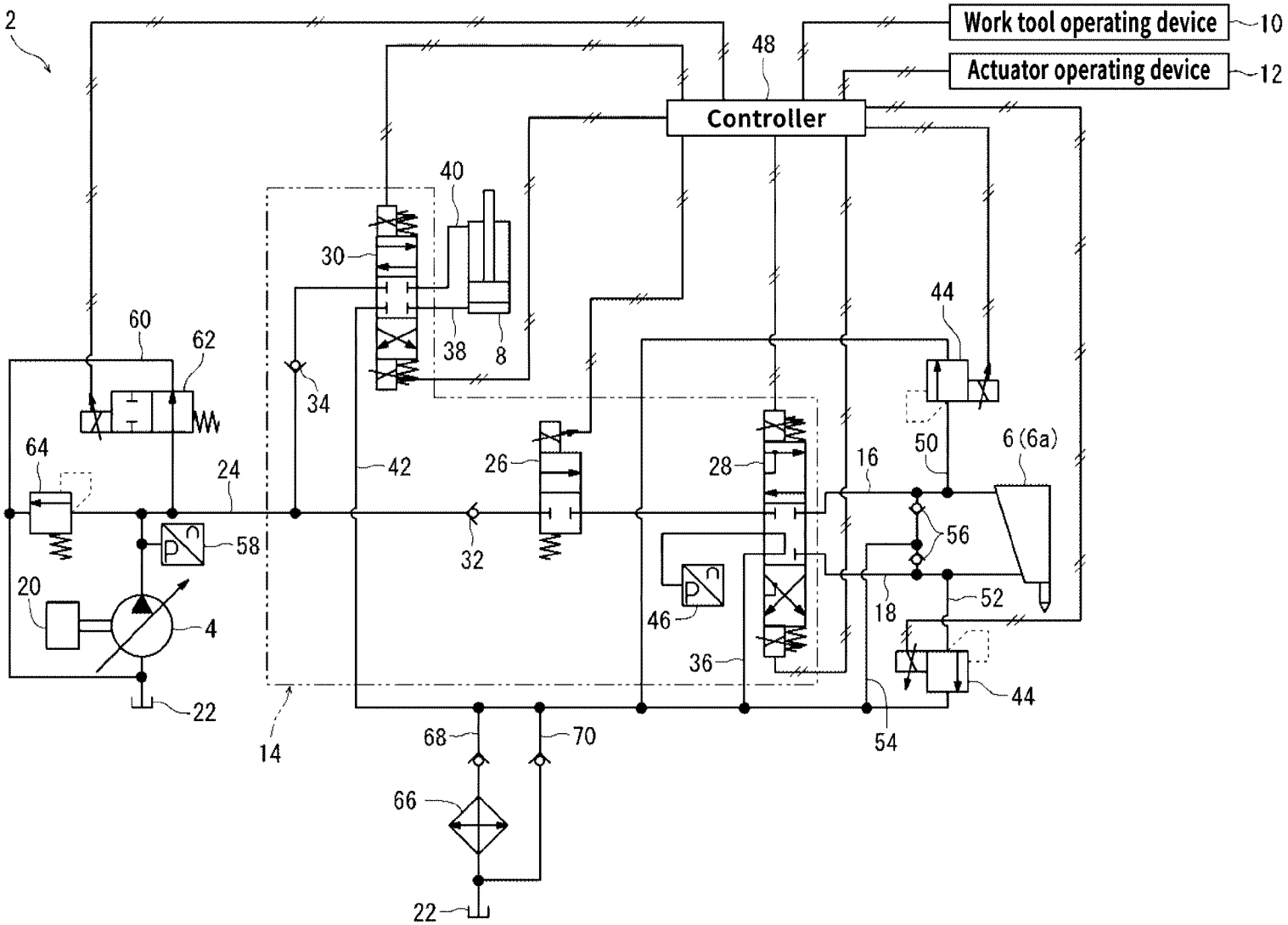
FIG. 1 is a hydraulic circuit diagram for the construction machine configured according to this invention.

As shown in FIG. 1, the hydraulic circuit 2, which may be mounted on the construction machine like hydraulic excavator, has the hydraulic pump 4 of variable capacity, the work tool 6 and actuator 8 both operated by hydraulic oil (delivery oil) delivered by the hydraulic pump 4, the work tool operating device 10 to output the signal to operate the work tool 6, the actuator operating device 12 to output the signal to operate the actuator 8, the control valve 14 allowing the hydraulic pump 4 to supply the hydraulic oil to the work tool 6 and the actuator 8 based on the signal output from the work tool and actuator operating devices 10, 12, and first and second conduits 16, 18 respectively connecting the control valve 14 and the work tool 6.

(Hydraulic Pump 4)

The hydraulic pump 4 is driven by an engine 20 to suck hydraulic oil from the hydraulic tank 22 and deliver it to a pump conduit 24. As depicted in FIG. 1, the pump conduit 24 connects hydraulic pump 4 and control valve 14. Also, as mentioned above, the hydraulic pump 4 delivers hydraulic oil to the work tool 6 and actuator 8, but a pilot pump may be provided separately.

(Work Tool 6)

Figure 2:
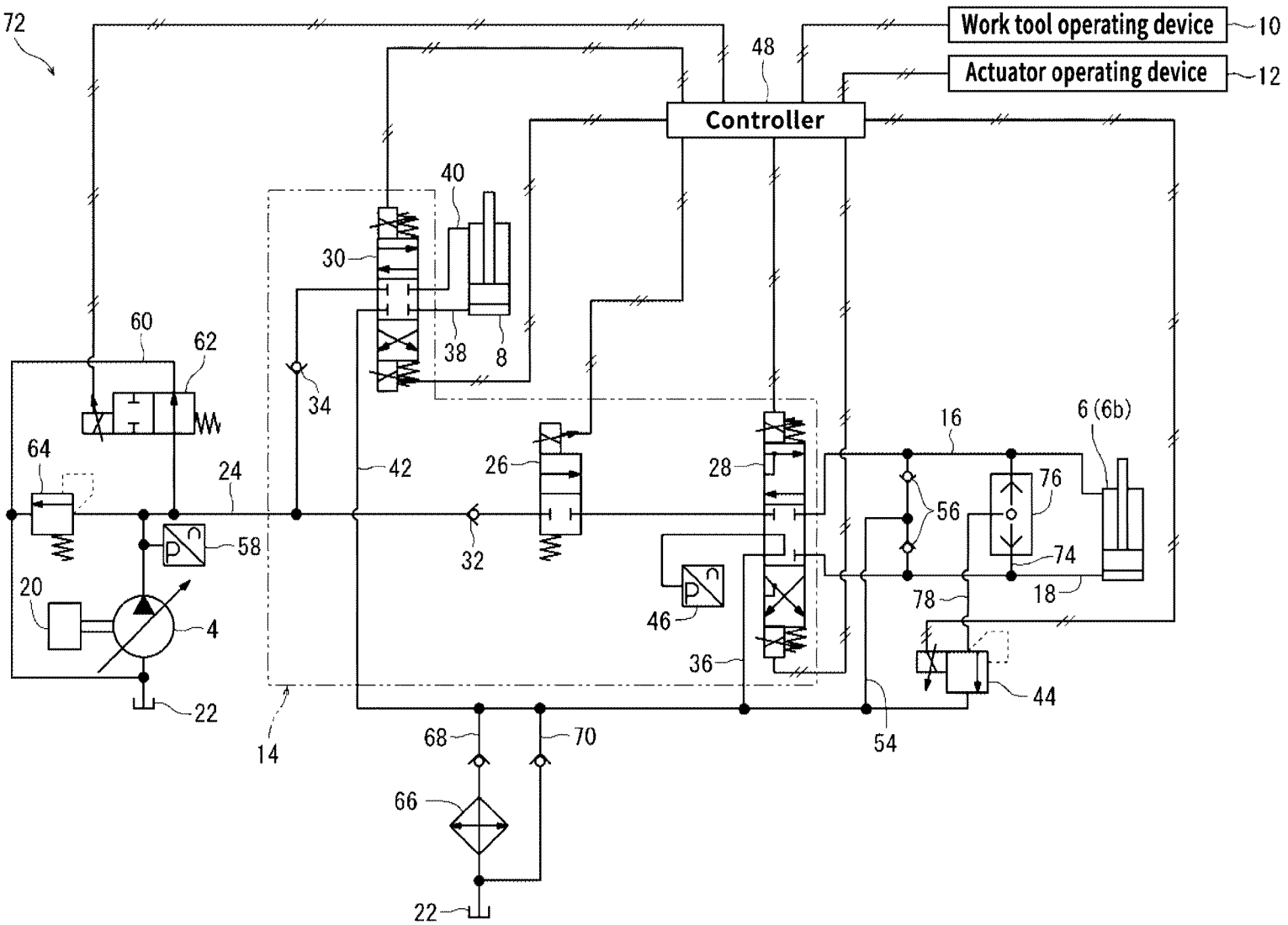
FIG. 2 is a first circuit diagram variation of the hydraulic circuit shown in FIG. 1.

The work tool 6 installed detachably in the hydraulic circuit 2 is either single-acting or double-acting work tool 6*a* or 6*b* (see FIGS. 1, 2, respectively). The single-acting work tool 6*a* depicted in FIG. 1 uses either of first and second conduits 16, 18 as an inflow route only and the other as outflow route only. As an example of single-acting work tool 6*a*, there is a hydraulic hammer for crushing concrete or stones.

Meanwhile, the double-acting work tool 6*b* as depicted in FIG. 2 uses both first and second conduits 16, 18 alternately as inflow and outflow routes. As the example of double-acting work tool 6*b*, there is the grapple for grabbing wood, etc., for example. The actuator for the double-acting work tool 6*b* may be either hydraulic cylinder or motor.

(Actuator 8)

The actuator 8 is illustrated as the hydraulic cylinder in FIGS. 1, 2, but it is not limited to the hydraulic cylinder and may be the hydraulic motor. Only one actuator 8 is shown in the illustrated embodiments, but two or more actuators 8 may be provided. As examples of the actuator 8, when the hydraulic circuit 2 is for hydraulic excavator, there are boom/arm cylinders swinging a boom/arm, a traveling motor traveling hydraulic excavator, a swiveling motor swiveling upper swiveling body, and others.

(Work Tool and Actuator Operating Devices 10, 12)

The work tool and actuator operating devices 10, 12 may be configured to have an input equipment (joystick, slide switch, pedal, etc., for example) which increases intensity of an output signal as an operating amount increases. Only one actuator operating device 12 is shown in the illustrated embodiments, but two or more actuator operating devices 12 may be provided.

When operated by an operator, the work tool operating device 10 outputs an electric or hydraulic signal to operate the work tool 6. Also, when operated by the operator, the actuator operating device 12 outputs the electric or hydraulic signal to operate the actuator 8. FIG. 1 illustrates a configuration where the work tool and actuator operating devices 10, 12 output electric signal. The electric signal output from the work tool and actuator operating devices 10, 12 is sent to the control valve 14 via a controller 48 mentioned later.

Note that, unlike the illustrated embodiments, the work tool and actuator operating devices 10, 12 may output hydraulic signal to the control valve 14. Here, a pressure sensor (not shown) detects the hydraulic signal output from the work tool and actuator operating devices 10, 12 and inputs detection result into the controller 48.

(Control Valve 14)

According to the illustrated embodiments, the control valve 14 includes meter-in/meter-out valves 26, 28 which control hydraulic oil flow rate flowing into/out of the work tool 6, actuator valve 30 which controls hydraulic oil flow rate flowing into/out of the actuator 8, a first check valve 32 mounted at the upstream side of the meter-in valve 26, and a second check valve 34 mounted at the upstream side of the actuator valve 30.

According to the illustrated embodiments, the meter-in/meter-out valves 26, 28 are of electromagnetic proportional type where the opening area of the valves 26, 28 is controlled by the controller 48 based on the electric signal output by the work tool operating device 10 to the controller 48, but the meter-in/meter-out valves 26, 28 may be of hydraulic pilot operated type operated by hydraulic signal output from the work tool operating device 10.

As depicted in FIG. 1, the meter-in valve 26 is a two port switching valve and is installed in the pump conduit 24. When the work tool operating device 10 outputs the signal, the meter-in valve 26 is opened by the controller 48.

The meter-out valve 28 is a four port switching valve and is provided between the meter-in valve 26 and work tool 6. The meter-out valve 28 connects the pump conduit 24 to either one of first and second conduits 16, 18 and also connects the other one of the first and second conduits 16, 18 to a first return conduit 36 according to the signal output from the work tool operating device 10. The first return conduit 36 leads from the meter-out valve 28 to the hydraulic tank 22.

According to the illustrated embodiments, similar to the meter-in valve 26 and others, the actuator valve 30 is of electromagnetic proportional type where the opening area of the valve 30 is controlled by the controller 48 based on the electric signal output to the controller 48 from the actuator operating device 12, but the valve 30 may be of hydraulic pilot operated type operated by hydraulic signal output from the actuator operating device 12.

The actuator valve 30 is the four port switching valve and is disposed in the pump conduit 24. The actuator valve 30 connects the pump conduit 24 to either one of third and fourth conduits 38, 40 and also connects the other one of the third and fourth conduits 38, 40 to a second return conduit 42 according to the signal output from the actuator operating device 12.

Both the third and fourth conduits 38, 40 connect the actuator valve 30 and actuator 8, and the second return conduit 42 leads from the actuator valve 30 to the hydraulic tank 22.

As depicted in FIG. 1, according to the illustrated embodiment, the hydraulic circuit 2 further has the tool's relief valve 44 to release the hydraulic oil flowing between the control valve 14 and the work tool 6, the pressure sensor 46 to detect the pressure of hydraulic oil flowing into the work tool 6, the controller 48, and first and second relief conduits 50, 52 respectively branched from the first and second conduits 16, 18 to the hydraulic tank 22.

(Tool's Relief Valve 44)

In the illustrated embodiment, the first and second relief conduits 50, 52 are provided with the tool's relief valve 44 respectively. The tool's relief valve 44 is to release the hydraulic oil flowing in the first and second relief conduits 50, 52 to the hydraulic tank 22 when the pressure of hydraulic oil in the first and second relief conduits 50, 52 exceeds the relief pressure.

The relief pressure of the tool's relief valve 44 is set to a required value (initial value) in advance, but when the tool's relief valve 44 is of electromagnetic proportional type, the initial value above may be modified appropriately by the controller 48 based on a kind of the work tool 6 input by the operator into the controller 48.

When the tool's relief valve 44 is of electromagnetic proportional type, the controller 48 may change the relief pressure of the tool's relief valve 44 not only when the kind of the work tool 6 is input but when the required signal is output from the work tool operating device 10.

When the signal is output from the work tool operating device 10, for example, the relief pressure of the tool's relief valve 44 provided at the outflow route side of the work tool 6 may be relieved. Thus, return oil from the work tool 6 branches into a route through the meter-out valve 28 and the route through the tool's relief valve 44 at an outflow route side, allowing to suppress back pressure increase in the work tool circuit. Note that, since the tool's relief valve 44 at the inflow route side of the work tool 6 does not give an impact on suppression of the back pressure increase, there is no need to change the relief pressure.

(Pressure Sensor 46)

The pressure sensor 46 is attached to the meter-out valve 28 and detects the pressure of hydraulic oil flowing from the meter-out valve 28 to the work tool 6 in either case when the hydraulic oil flows in first or second conduit 16 or 18. The result detected by the pressure sensor 46 is sent to the controller 48.

(Controller 48)

The controller 48 is comprised of a computer having processing and storage devices. The controller 48 controls the operation of the control valve 14 as well as the delivery rate of the hydraulic pump 4 based on the signal output from the work tool and actuator operating devices 10, 12.

As depicted in FIG. 1, the first and second conduits 16, 18 are also connected to the hydraulic tank 22 by way of a make-up conduit 54. The make-up conduit 54 is disposed with a pair of make-up check valves 56 in order to avoid a cavitation from being generated in the first and second conduits 16, 18 when a negative pressure occurs in the passages 16, 18.

According to the illustrated embodiment, the hydraulic circuit 2 includes a pressure sensor 58 to detect the pressure of hydraulic oil in the pump conduit 24, a bypass conduit 60 branched from the pump conduit 24 to the hydraulic tank 22, a bypass valve 62 of electromagnetic proportional type to control hydraulic oil flow rate returning through the bypass conduit 60 to the hydraulic tank 22, and a main relief valve 64 disposed at an upstream side of the control valve 14 to release the hydraulic oil delivered by the hydraulic pump 4.

The main relief valve 64 is to release the hydraulic oil flowing in the pump conduit 24 to the hydraulic tank 22 when the pressure of hydraulic oil in the pump conduit 24 exceeds the relief pressure. In general, the relief pressure of the main relief valve 64 is set higher than that of the tool's relief valve 44.

As depicted in FIG. 1, the first and second return conduits 36, 42 both connected to the hydraulic tank 22, the first and second relief conduits 50, 52, and the make-up conduit 54 are joined together before the hydraulic tank 22. The hydraulic oil is to return to the hydraulic tank 22 by flowing through either a cooling conduit 68 via an oil cooler 66 or non-cooling conduit 70 not via the oil cooler 66.

Next, an explanation is provided about the operation of hydraulic circuit 2 for construction machine, as mentioned above.

When the work tool and actuator operating devices 10, 12 are not operated, the signal is not output from the operating devices 10, 12. Here, the meter-in/meter-out/actuator valves 26, 28, and 30 are closed, the delivery oil from the hydraulic pump 4 does not flow into the work tool 6 and actuator 8, and the work tool 6 and others do not work.

Also, when the work tool operating device 10, etc. is not operated, the controller 48 opens the bypass valve 62. Thus, the delivery oil from the hydraulic pump 4 returns to the hydraulic tank 22 through the bypass conduit 60.

(Operation of Work Tool 6)

When the work tool operating device 10 is operated, the operating device 10 outputs the signal. Then, the controller 48 operates the meter-in/meter-out valves 26, 28 to open an oil passage from the hydraulic pump 4 to the work tool 6 and also reduce the opening area of the bypass valve 62. Thus, the delivery oil is supplied from the hydraulic pump 4 to the work tool 6 to run the work tool 6.

When the amount operated by the work tool operating device 10 increases, the intensity of signal output from the work tool operating device 10 rises as the operation amount increases. As the intensity of signal from the work tool operating device 10 rises, the controller 48 increases the delivery rate from the hydraulic pump 4 and the opening area of the meter-in/meter-out valves 26, 28, and also decreases the opening area of the bypass valve 62. So, as the amount operated by the work tool operating device 10 increases, a working speed of the work tool 6 rises.

However, when the pressure (pressure of hydraulic oil flowing from the meter-out valve 28 to the work tool 6) detected by the pressure sensor 46 exceeds the predetermined value, the controller 48 reduces the delivery rate of the hydraulic pump 4 compared to cases where the pressure detected by the pressure sensor 46 is not more than the predetermined value even if the amount operated by the work tool operating device 10 does not change.

This allows to suppress the hydraulic oil flow rate flowing through the tool's relief valve 44 at the inflow route side of the work tool 6 when the pressure of hydraulic oil exceeds the predetermined value in the inflow route side (first or second conduit 16 or 18) to the work tool 6, enabling to reduce the capacity of the tool's relief valve 44. The hydraulic oil flow rate is suppressed flowing through the tool's relief valve 44, so an energy loss is relieved during relief.

It is preferable that the delivery rate of the hydraulic pump 4 is not more than the capacity (flow rate allowing to pass through) of the tool's relief valve 44 after the delivery rate is reduced and all the hydraulic oil delivered from the hydraulic pump 4 is able to pass through the tool's relief valve 44 after reducing the delivery rate.

The predetermined value above to control and reduce the delivery rate of hydraulic pump 4 may be set to any value not more than the relief pressure (initial value) of the tool's relief valve 44. However, from a point of view to reduce the impact on the operation of the work tool 6, the predetermined value above is preferably as large as possible.

When the controller 48 changed the relief pressure of the tool's relief valve 44 from the initial value based on the kind of work tool 6, the predetermined valve above may be changed according to the change of the relief pressure.

However, when the relief pressure of the tool's relief valve 44 is reduced at the outflow route side of the work tool 6 in order to suppress the back pressure increase in the work tool circuit while operating the work tool 6, there is no need to change the predetermined valve above according to the reduction of the relief pressure. The above predetermined value is to suppress the hydraulic oil flow rate flowing through the tool's relief valve 44 at the inflow route side of the work tool 6, and is less related to the relief pressure of the tool's relief valve 44 at the outflow route side of the work tool 6.

The controller 48 controls the delivery rate as explained above (control which reduces the delivery rate of the hydraulic pump 4 when the pressure detected by the pressure sensor 46 exceeds the predetermined value) in cases when the signal is output from the work tool operating device 10 only and also when the signal is output from both work tool and actuator operating devices 10, 12.

(Operation of the Work Tool 6 and Actuator 8)

When the work tool and actuator operating devices 10, 12 are operated, the signal is output from both operating devices 10, 12. Then, the controller 48 operates the meter-in/meter-out/actuator valves 26, 28, and 30 to open each oil passage from the hydraulic pump 4 to the work tool 6 and actuator 8, and also reduce the opening area of the bypass valve 62. Thus, the delivery oil is supplied from the hydraulic pump 4 to the work tool 6 and actuator 8 to run the work tool 6 and actuator 8.

As explained above, as the strength of the signal output from the work tool operating device 10 increases, the opening area of the meter-in valve 26 is increased by the controller 48. However, when the signal is output from both work tool and actuator operating devices 10, 12, the opening area of the meter-in valve 26 is controlled by the controller 48 to be smaller as compared when the signal is output only from the work tool operating device 10.

That is, when comparing the case (1) the signal is output only from the work tool operating device 10 and the case (2) the signal is output from both work tool and actuator operating devices 10, 12, the controller 48 controls to make the opening area of the meter-in valve 26 in the case (1) smaller than that in the case (2) even if the signal output from the work tool operating device 10 has the same strength in both cases (1), (2).

More specifically, when the signal is output from both of work tool and actuator operating devices 10, 12, the controller 48 performs the following control. The pressure at downstream side of the meter-in valve 26 is controlled to be less than the pressure at upstream side of the meter-in valve 26 by reducing the opening area of the meter-in valve 26 so that the pressure (pressure of hydraulic oil flowing into the work tool 6) at downstream side of the meter-in valve 26 will not reach to the relief pressure of the tool's relief valve 44 before the pressure (pressure of hydraulic oil flowing into the actuator 8) at upstream side of the meter-in valve 26 reaches to the relief pressure of the main relief valve 64.

Thus, even if the relief pressure of the tool's relief valve 44 is set higher than that of the main relief valve 64, the pressure of hydraulic oil flowing into the actuator 8 can be raised higher than the relief pressure of the tool's relief valve 44 (until the relief pressure of the main relief valve 64 in the illustrated embodiment). So, the operability becomes better when operating the work tool 6 and actuator 8 simultaneously.

Also, the illustrated embodiment has the meter-in/meter-out valves 26, 28 which control hydraulic oil flow rate flowing into/out of the work tool 6, so there is no need to reduce the opening of the meter-out valve 28 in conjunction with reducing the opening of the meter-in valve 26, enabling to suppress the back pressure increase in the work tool circuit.

Note that the present invention can accept various variations without being limited to the embodiment explained above. The embodiment explained above has given the example with two tool's relief valves 44, but the tool's relief valve 44 may be one.

Referring to FIG. 2 for illustration of this example, the hydraulic circuit, the whole of which is indicated by a number 72, includes the connecting conduit 74 connecting the first and second conduits 16, 18, the shuttle valve 76 disposed in the connecting conduit 74, and the relief conduit 78 extending from the exit of the shuttle valve 76 to the hydraulic tank 22. Single tool's relief valve 44 is provided in the relief conduit 78. The example depicted in FIG. 2 has one tool's relief valve 44, so this example can suppress a cost compared to the case provided with two tool's relief valves 44 (configuration depicted in FIG. 1).

Figure 3:
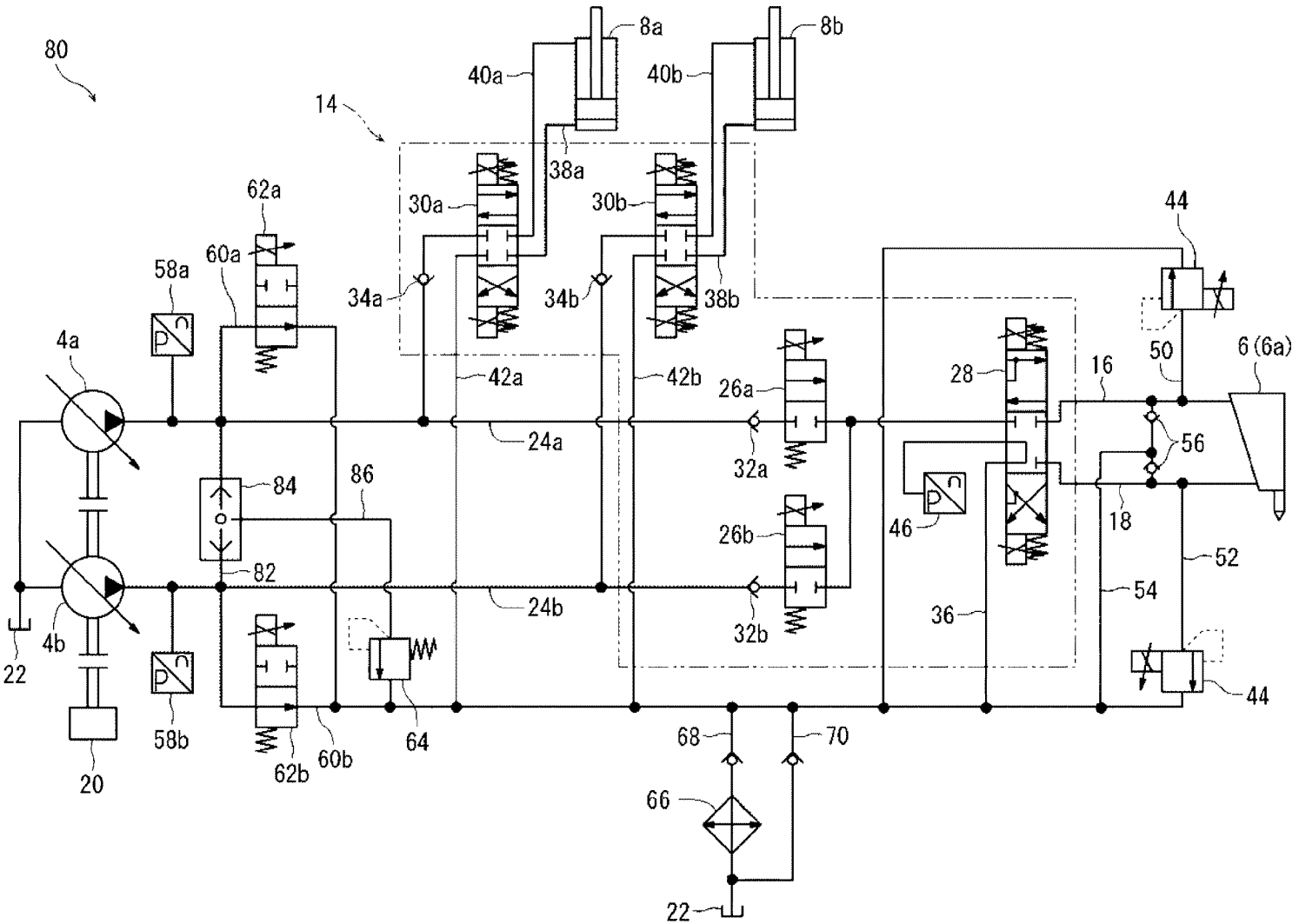
FIG. 3 is the second circuit diagram variation of the hydraulic circuit shown in FIG. 1.

Also, as another variation, the configuration with two hydraulic pumps 4 may be provided as shown in FIG. 3. The hydraulic circuit 80 depicted in FIG. 3 is provided with two hydraulic pumps 4 (4*a*, 4*b*), and also provided with two pump conduits 24 (24*a*, 24*b*), two meter-in valves 26 (26*a*, 26*b*), two actuators 8 (8*a*, 8*b*), two actuator valves 30 (30*a*, 30*b*), two bypass valves 62 (62*a*, 62*b*), and others.

Also, the hydraulic circuit 80 depicted in FIG. 3 is provided with a coupling conduit 82 coupling first and second pump conduits 24*a*, 24*b*, a shuttle valve 84 disposed in the coupling conduit 82, and a main relief conduit 86 extending from the exit of the shuttle valve 84 to the hydraulic tank 22. The main relief conduit 86 is installed with the main relief valve 64.

In FIG. 3, in order to avoid complicated drawing, the work tool and actuator operating devices 10, 12 and controller 48 are omitted.

When two hydraulic pumps 4*a*, 4*b* are provided as shown in FIG. 3, the hydraulic oil is supplied to the work tool 6 from either first hydraulic pump 4*a* only, second hydraulic pump 4*b* only, or both hydraulic pumps 4*a*, 4*b*.

When both hydraulic pumps 4*a*, 4*b* supply same volume of hydraulic oil to the work tool 6 respectively, as the intensity of the signal output from the work tool operating device 10 rises, the opening area of each of bypass valves 62*a*, 62*b* decreases gradually and the opening area of each of meter-in valves 26*a*, 26*b* increases gradually.

When the pressure detected by the pressure sensor 46 exceeds the predetermined value which is set to not more than the relief pressure of the tool's relief valve 44, the discharge rate from each of hydraulic pumps 4*a*, 4*b* is reduced.

When the signal is output from both the work tool and actuator operating devices 10, 12 in the example shown in FIG. 3, the controller reduces the opening area of the meter-in valves 26*a*, 26*b* to make the pressure at the downstream side of the meter-in valves 26*a*, 26*b* lower than that at the upstream side of the meter-in valves 26*a*, 26*b* lest the pressure at the downstream side of the meter-in valves 26*a*, 26*b* should reach to the relief pressure of the tool's relief valve 44 before the pressure at the upstream side of the meter-in valves 26*a*, 26*b* reaches to the relief pressure of the main relief valve 64.

When the hydraulic oil is supplied to the work tool 6 from first hydraulic pump 4*a* only, the opening area of first meter-in valve 26*a* is controlled and the opening area of second meter-in valve 26*b* is kept closed according to the operation of the work tool operating device 10.

On the contrary, when the hydraulic oil is supplied to the work tool 6 from second hydraulic pump 4*b* only, the opening area of second meter-in valve 26*b* is controlled and the opening area of first meter-in valve 26*a* is kept closed according to the operation of the work tool operating device 10.

Figure 4:
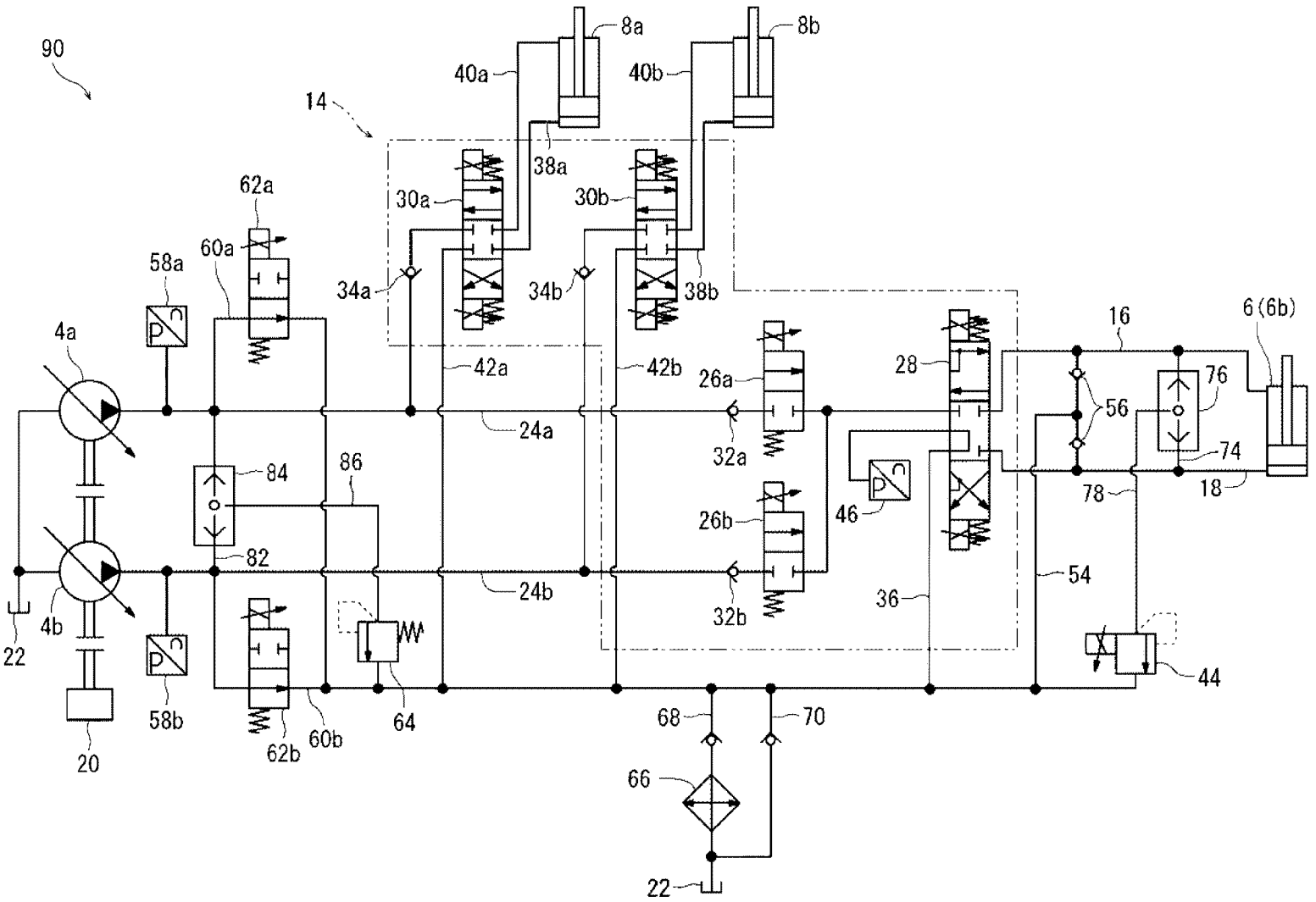
FIG. 4 is the third circuit diagram variation of the hydraulic circuit shown in FIG. 1.

Moreover, similar to the hydraulic circuit 90 shown in FIG. 4 in addition to the example shown in FIG. 3, there may be only one tool's relief valve 44 when two hydraulic pumps 4 (4*a*, 4*b*) are provided.

What is claimed is:

1. A hydraulic circuit for a construction machine comprising:

a hydraulic pump of variable capacity, a work tool operated by hydraulic oil delivered by the hydraulic pump, a work tool operating device to output a signal for operating the work tool, a control valve allowing the hydraulic pump to supply hydraulic oil to the work tool based on the signal output from the work tool operating device, a tool's relief valve to release the hydraulic oil flowing between the control valve and the work tool, a pressure sensor to detect a pressure of hydraulic oil flowing into the work tool, a controller to reduce a delivery rate from the hydraulic pump when the pressure detected by the pressure sensor exceeds a predetermined value, first and second conduits respectively connecting the control valve and the work tool, a first relief conduit branched from the first conduit to a hydraulic tank, and a second relief conduit branched from the second conduit to the hydraulic tank, wherein the tool's relief valve is provided in each of the first and second relief conduits.

2. The hydraulic circuit for the construction machine of claim 1, wherein the predetermined value is set to not more than a relief pressure of the tool's relief valve.

3. The hydraulic circuit for the construction machine of claim 1, wherein the control valve has a meter-in valve which controls hydraulic oil flow rate flowing into the work tool and a meter-out valve which controls hydraulic oil flow rate flowing out of the work tool.

4. A hydraulic circuit for a construction machine comprising:

a hydraulic pump of variable capacity, a work tool operated by hydraulic oil delivered by the hydraulic pump, a work tool operating device to output a signal for operating the work tool, a control valve allowing the hydraulic pump to supply hydraulic oil to the work tool based on the signal output from the work tool operating device, a tool's relief valve to release the hydraulic oil flowing between the control valve and the work tool, a pressure sensor to detect a pressure of hydraulic oil flowing into the work tool, a controller to reduce a delivery rate from the hydraulic pump when the pressure detected by the pressure sensor exceeds a predetermined value, first and second conduits respectively connecting the control valve and the work tool, a connecting conduit connecting the first and second conduits, a shuttle valve disposed in the connecting conduit, and the relief conduit extending from an exit of the shuttle valve to the hydraulic tank, wherein the tool's relief valve is provided in the relief conduit.

5. The hydraulic circuit for the construction machine of claim 1, wherein the tool's relief valve is of electromagnetic proportional type.

6. The hydraulic circuit for the construction machine of claim 4, wherein the predetermined value is set to not more than a relief pressure of the tool's relief valve.

7. The hydraulic circuit for the construction machine of claim 4, wherein the control valve has a meter-in valve which controls hydraulic oil flow rate flowing into the work tool and a meter-out valve which controls hydraulic oil flow rate flowing out of the work tool.

8. The hydraulic circuit for the construction machine of claim 4, wherein the tool's relief valve is of electromagnetic proportional type.

9. A hydraulic circuit for a construction machine comprising:

a hydraulic pump, a work tool and an actuator respectively operated by hydraulic oil delivered by the hydraulic pump, a work tool operating device to output a signal for operating the work tool, an actuator operating device to output the signal for operating the actuator, a control valve allowing the hydraulic pump to supply hydraulic oil to the work tool and the actuator based on the signal output from the work tool and actuator operating devices, a main relief valve disposed at an upstream side of the control valve to release the hydraulic oil delivered by the hydraulic pump, a tool's relief valve to release the hydraulic oil flowing between the control valve and the work tool, and a controller to control an operation of the control valve, wherein, the control valve includes meter-in/meter-out valves which control hydraulic oil flow rate flowing into/out of the work tool, wherein, when the signal is output from both the work tool and actuator operating devices, the controller reduces an opening area of the meter-in valve so that the pressure at a downstream side of the meter-in valve is made lower than that at the upstream side of the meter-in valve.

10. The hydraulic circuit for the construction machine of claim 9, wherein, when the signal is output from both the work tool and actuator operating devices, the controller reduces the opening area of the meter-in valve to make the pressure at the downstream side of the meter-in valve lower than that at the upstream side of the meter-in valve lest the pressure at the downstream side of the meter-in valve should reach to the relief pressure of the tool's relief valve before the pressure at the upstream side of the meter-in valve reaches to the relief pressure of the main relief valve.

11. The hydraulic circuit for the construction machine of claim 9, wherein the hydraulic pump is a variable capacity type and includes the pressure sensor to detect the pressure of hydraulic oil flowing into the work tool, and the controller reduces the delivery rate from the hydraulic pump when the pressure detected by the pressure sensor exceeds the predetermined value.

* * * * *